US011152182B2

(12) United States Patent
Watanabe

(10) Patent No.: US 11,152,182 B2
(45) Date of Patent: Oct. 19, 2021

(54) X-RAY TUBE ASSEMBLY

(71) Applicant: CANON ELECTRON TUBES & DEVICES CO., LTD., Otawara (JP)

(72) Inventor: Toshimi Watanabe, Yaita (JP)

(73) Assignee: CANON ELECTRON TUBES & DEVICES CO., LTD., Otawara (JP)

( * ) Notice: Subject to any disclaimer, the term of this patent is extended or adjusted under 35 U.S.C. 154(b) by 0 days.

(21) Appl. No.: 16/939,442

(22) Filed: Jul. 27, 2020

(65) Prior Publication Data

US 2021/0233733 A1 Jul. 29, 2021

(30) Foreign Application Priority Data

Jan. 28, 2020 (JP) ..... JP2020-011782

(51) Int. Cl.
*H01J 35/12* (2006.01)

(52) U.S. Cl.
CPC ..... *H01J 35/13* (2019.05); *H01J 2235/1204* (2013.01); *H01J 2235/1233* (2013.01); *H01J 2235/1262* (2013.01)

(58) Field of Classification Search
CPC ..... H01J 35/13; H01J 2235/1233; H01J 2235/1262; H01J 2235/1204
See application file for complete search history.

(56) References Cited

U.S. PATENT DOCUMENTS 4,439,870 A * 3/1984 Poulsen ..... H01J 35/08 378/143
2002/0097838 A1* 7/2002 Saito ..... H01J 35/106 378/130

FOREIGN PATENT DOCUMENTS

JP 6-162974 A 6/1994

OTHER PUBLICATIONS

Machine Translation of JP 06-162974 A (Year: 1994).*

* cited by examiner

*Primary Examiner* — Chih-Cheng Kao
(74) *Attorney, Agent, or Firm* — Oblon, McClelland, Maier & Neustadt, L.L.P.

(57) ABSTRACT

According to one embodiment, an X-ray tube assembly includes a cathode emitting electrons, an anode target generating X-rays when the electrodes emitted from the cathode collide with the anode target, an anode block, a coolant pipe, and a protective film. The anode block includes a tube portion, and a bottom portion closing one end side of the tube portion and joined to the anode target. The coolant pipe is located on an inner side of the tube portion, includes an outlet from which a coolant is discharged toward the bottom portion, and forms a flow passage of the coolant between the coolant pipe and the anode block. The protective film covers an inner surface of the bottom portion and is formed of hard gold containing nickel.

9 Claims, 3 Drawing Sheets

X-RAY TUBE ASSEMBLY

CROSS-REFERENCE TO RELATED APPLICATIONS

This application is based upon and claims the benefit of priority from Japanese Patent Application No. 2020-11782, filed Jan. 28, 2020, the entire contents of which are incorporated herein by reference.

FIELD

Embodiments described herein relate generally to an X-ray tube assembly.

BACKGROUND

An X-ray tube assembly used for X-ray fluorescence analysis, etc., generates X-rays by making electrons emitted from a cathode collide with an anode target. Since heat is generated by the collision of the electrons, the anode target and its periphery tend to be heated to high temperature. Therefore, in many cases, the X-ray tube assembly has a cooling mechanism which cools the anode target and its periphery. For example, the anode target is cooled by a coolant flowing in a flow passage formed in its vicinity.

Meanwhile, in some cases, bubbles are generated in the coolant by boiling of the coolant or a pressure difference in a coolant circuit. Since these bubbles generate shock waves when evaporating, these bubbles may cause corrosion and erosion of the inner surfaces of members constituting the flow passage of the coolant.

DETAILED DESCRIPTION

Figure 1:
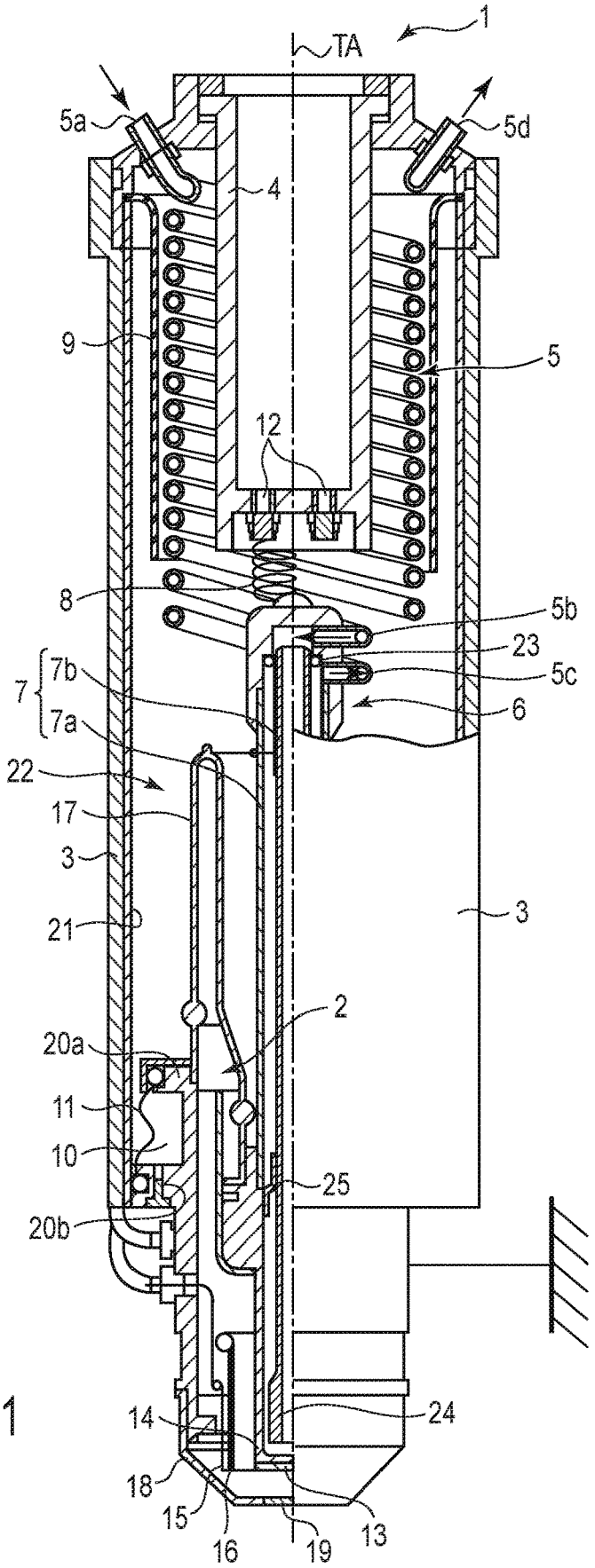
FIG. 1 is a cross-sectional view showing an example of an X-ray tube assembly according to the present embodiment.

In general, according to one embodiment, there is provided an X-ray tube assembly including a cathode configured to emit electrons, an anode target configured to generate X-rays when the electrodes emitted from the cathode collide with the anode target, an anode block, a coolant pipe, and a protective film. The anode block includes a tube portion, and a bottom portion closing one end side of the tube portion and joined to the anode target. The coolant pipe is located on an inner side of the tube portion, includes an outlet from which a coolant is discharged toward the bottom portion, and forms a flow passage of the coolant between the coolant pipe and the anode block. The protective film covers an inner surface of the bottom portion and is formed of hard gold containing nickel.

One embodiment will be described hereinafter with reference to the accompanying drawings. The disclosure is merely an example, and proper changes in keeping with the spirit of the invention, which are easily conceivable by a person of ordinary skill in the art, come within the scope of the invention as a matter of course. In addition, in some cases, in order to make the description clearer, the widths, thicknesses, shapes, etc., of the respective parts are illustrated schematically in the drawings, rather than as an accurate representation of what is implemented. However, such schematic illustration is merely exemplary, and in no way restricts the interpretation of the invention. In addition, in the specification and drawings, the same elements as those described in connection with preceding drawings are denoted by the same reference numbers, and detailed descriptions of them which are considered redundant are omitted unless necessary.

FIG. 1 is a cross-sectional view showing an example of an X-ray tube assembly 1 according to the present embodiment. The X-ray tube assembly 1 includes an X-ray tube 2 and a tube container 3 containing the X-ray tube 2. The X-ray tube assembly 1 further includes a high-voltage receptacle 4, a cooling pipe 5, a joint connector (hereinafter referred to simply as a joint) 6, a coolant pipe 7, a conductor spring 8, an insulating cylinder 9, a bellows 11 and the like. A direction parallel to a tube axis TA will be referred to as an axial direction. With regard to the axial direction, a direction toward the X-ray tube 2 will be referred to as a downward direction (a lower side) and a direction opposite to the downward direction will be referred to as an upward direction (an upper side). In addition, a direction perpendicular to the tube axis TA will be referred to as a radial direction.

The high-voltage receptacle 4 is, to be connected to a high-voltage cable, formed in the shape of a bottomed cylinder which is open at its upper end and is closed at its lower end. The high-voltage receptacle 4 is centered on the tube axis TA and is liquid-tightly disposed on the upper side in the tube container 3 which will be described later. The high-voltage receptacle 4 includes a connecting terminal 12 penetrating its bottom portion. The connecting terminal 12 includes a bushing of an external electric circuit inserted in the high-voltage receptacle 4, and a terminal. The lower end of the connecting terminal 12 is connected to the joint 6 via the conductor spring 8.

The conductor spring 8 electrically connects the high-voltage receptacle 4 and the coolant pipe 7. Accordingly, high voltage is supplied to an anode target 13 which will be described later via the coolant pipe 7.

The insulating cylinder 9 is formed of a substantially cylindrical insulator and is disposed on the outer side of the high-voltage receptacle 4. Although not shown in the drawing, the insulating cylinder 9 is structured such that an insulating oil can flow. The insulating cylinder 9, for example, its upper end portion is fixed to the inner side of the tube container 3.

The cooling pipe 5 is a pipe which makes a coolant, for example, pure water as a water coolant flow. The cooling pipe 5 is helically disposed between the high-voltage receptacle 4 and the insulating cylinder 9. The cooling pipe 5 is formed of a first cooling pipe 5*b* having an inlet 5*a* to which the coolant is supplied and a second cooling pipe 5*c* having an outlet 5*a* from which the coolant is discharged.

In the first cooling pipe 5*b*, the inlet 5*a* is connected to a circulation cooling device, etc., (not shown) which is the supply source of the coolant, and its end portion on the opposite side to the inlet 5*a* is connected to the joint 6. On the other hand, in the second cooling pipe 5*c*, the outlet 5*d* is connected to the circulation cooling device, etc. (not shown), and its end portion on the opposite side to the outlet 5*d* is connected to the joint 6. Note that, as long as the cooling pipe 5 is held without being in contact with the outer circumferential wall of the high-voltage receptacle 4, the cooling pipe 5 can be structured in any way and may not be helically disposed.

The joint 6 is disposed in the central portion of the X-ray tube assembly 1, for example, on the tube axis TA, and connects the coolant pipe 7 and the cooling pipe 5. Note that, although not described in detail, a first passage which is open in a direction perpendicular to the tube axis TA and is liquid-tightly connected to the first cooling pipe 5*b*, a second passage which is open in a direction perpendicular to the tube axis TA and is liquid-tightly connected to the second cooling pipe 5*c*, and a third passage which extends along the tube axis TA and communicates with both the first passage and the second passage are formed in the joint 6.

The coolant pipe 7 is connected to the lower portion of the joint 6 and extends along the tube axis TA. The coolant pipe 7 is formed in the shape of a double cylinder centered on the tube axis TA. That is, the coolant pipe 7 includes a cylindrical outer pipe 7*a* and a cylindrical inner pipe 7*b* disposed on the inner side of the outer pipe 7*a*. In addition, the coolant pipe 7 includes an elastic member 23 and a support member 25 inside.

The outer pipe 7*a* is liquid-tightly joined to the lower portion of the joint 6 and the upper portion of an anode block 14 which will be described later. The outer pipe 7*a* is connected to the second cooling pipe 5*c* communicating with the outlet 5*d* via the joint 6.

In the inner pipe 7*b*, its upper end portion is fitted in the joint 6 (more specifically, the third passage described above), its middle portion is supported on the support member 25, and a tip nozzle portion 24 is disposed in its lower end portion. The inner pipe 7*b* is connected to the first cooling pipe 5*b* communicating with the inlet 5*a* via the joint 6.

The elastic member 23 is disposed between the outer circumferential portion of the inner pipe 7*b* and the joint 6 in the vicinity of the fitting portion. The elastic member 23 is formed of a rubber member made of resin. The shape of the elastic member 23 is, for example, the shape of an O-ring or a pipe. The cross-sectional shape of the elastic member 23 may be a circular shape or a rectangular shape.

The X-ray tube 2 is disposed on the lower side inside the tube container 3. The X-ray tube 2 includes an anode target (anode) 13, an anode block 14, a cathode 15, a Wehnelt electrode 16, a first vacuum tube 17, a second vacuum tube 18 and an X-ray transmissive window (window portion) 19. When a high-voltage cable is connected to the high-voltage receptacle 4, high voltage (tube voltage) is applied between the anode target 13 and the cathode 15.

The anode block 14 is formed in the shape of a bottomed cylinder centered on the tube axis TA. On the opening side of the anode block 14, the lower end portion of the outer pipe 7*a* is fixed. On the inner side of the anode block 14, the tip nozzle portion 24 of the inner pipe 7*b* is disposed. The coolant is discharged from this tip nozzle portion 24 toward the bottom portion of the anode block 14 (or in the direction of installation of the anode target 13).

In the X-ray tube assembly 1, the joint 6, the coolant pipe 7 and the anode block 14 described above are assembled and constitute a flow passage which makes the coolant flow. Note that, although the joint 6, the coolant pipe 7 and the anode block 14 are described as separate members in the first place, as long as they constitute a flow passage which makes the coolant flow, all of them may be integrally formed or a part of them may be integrally formed. As the coolant circulates through the flow passage formed of the joint 6, the coolant pipe 7 and the anode block 14, and the cooling pipe 5, an insulating oil filled with an internal space 22 which will be described later, the anode target 13 and the like are cooled.

The anode target 13 is joined to the bottom portion of the anode block 14. The anode target 13 emits X-rays when electrons collide with it. At this time, the anode target 13 is heated to high temperature by the collision of the electrons but is cooled by the coolant flowing in the flow passage inside the anode block 14. Relatively, positive voltage is applied to the anode target 13, and negative voltage is applied to the cathode 15. For example, the cathode 15 is electrically grounded.

The cathode 15 is formed of a ring-shaped filament and emits electrons. The cathode 15 is disposed outward in the radial direction from the anode target 13 (or the anode block 14) with a predetermined space. The electrons emitted from the cathode 15 travel beyond the lower end portion of the Wehnelt electrode 16 which will be described later and collide with the anode target 13.

The Wehnelt electrode 16 is formed in a cylindrical shape and is disposed between the anode target 13 and the cathode 15. The Wehnelt electrode 16 makes the electrons emitted from the cathode 15 converge to the anode target 13.

The first vacuum tube 17 is formed of an inner cylinder and an outer cylinder. In the first vacuum tube 17, the upper end portions of the inner cylinder and the outer cylinder are joined together. The inner cylinder and the outer cylinder are formed in a substantially cylindrical shape and are formed of, for example, a glass material or a ceramic material. In the first vacuum tube 17, the lower end portion of the inner cylinder is vacuum-tightly connected to the anode block 14, and the lower end portion of the outer cylinder is vacuum-tightly connected to the wall portion of the X-ray tube 2 as a part of the wall surface of the X-ray tube 2.

The second vacuum tube 18 is formed in a bottomed substantially cylindrical shape. In the second vacuum tube 18, its upper end portion is vacuum-tightly connected to the wall portion of the X-ray tube 2 as a part of the wall surface of the X-ray tube 2. The second vacuum tube 18 is electrically grounded with the tube container 3 which will be described later.

The X-ray transmissive window 19 is formed in the shape of a thin plate and is vacuum-tightly jointed to an opening penetrating the vicinity of the center of the bottom portion of the second vacuum tube 18. The X-ray transmissive window 19 transmits the X-rays generated from the anode target 13 when the electrons collide with the anode target 13, and emits the X-rays to the outside of the X-ray tube assembly 1. The X-ray transmissive window 19 is formed of an X-ray transmissive material, for example, a beryllium thin plate. In addition, the X-ray tube 2 includes a first convex portion 20*a* and a second convex portion 20*b* projecting outward in the radial direction in a part of its outer wall.

The tube container 3 is a hermetically sealed container accommodating the units of the X-ray tube assembly 1 inside. The tube container 3 is formed in a substantially cylindrical shape centered on the tube axis TA. The tube container 3 is formed of, for example, a metal material. In addition, a lead plate 21 is attached to the inner wall of the tube container 3. The internal space 22 inside the tube container 3 (the lead plate 21) is filled with an insulating oil. Here, the internal space 22 is, for example, a space on the inner side of the tube container 3 and on the outer side of the X-ray tube 2 and the high-voltage receptacle 4 and other than an air basin 10.

The bellows 11 is disposed in a predetermined portion on the lower side of the tube container 3 so as to separate the internal space 22 and the air basin 10. In the bellows 11, one end portion is fixed to the first convex portion 20*a*, and the other end portion is fixed to the second convex portion 20*b*. The bellows 11 is formed of an elastic member made of resin, and absorbs the expansion and contraction of the insulating oil by expanding and contracting in the air basin 10. Note that the bellows 11 is an expandable and contractible member and is, for example, a rubber bellows (a rubber film).

In the present embodiment, in the X-ray tube assembly 1, the coolant is taken into the first cooling pipe Sb from the inlet Sa and flows into the inner pipe 7*b* via the joint 6. The coolant flowing in the inner pipe 7*b* is discharged from the tip nozzle portion 24 of the inner pipe 7*b*, and passes through the flow passage formed of the inner surface of the anode block 14 or the inner surface of the outer pipe 7*a* and the outer circumferential portion of the inner pipe 7*b*. After that, the coolant flows into the second cooling pipe 5*c* via the joint 6 and is discharged from the outlet.

Figure 2:
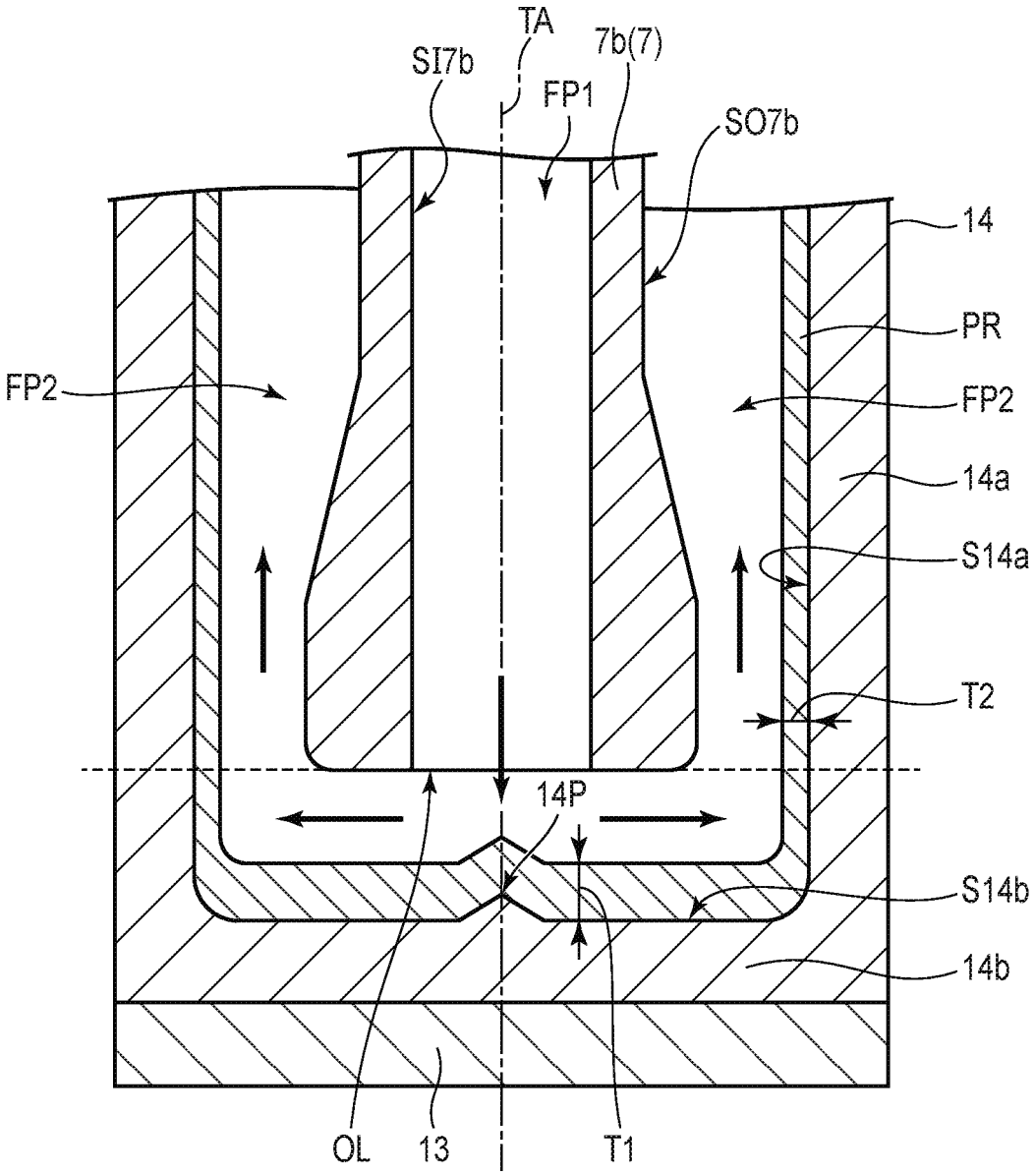
FIG. 2 is an enlarged cross-sectional view of a part of an X-ray tube of the present embodiment.

FIG. 2 is an enlarged cross-sectional view showing a part of the X-ray tube 2 of the present embodiment. FIG. 2 shows the vicinity of the anode target 13.

The anode block 14 has a cylindrical tube portion 14*a* and a bottom portion 14*b* which closes one end side (that is, the anode target 13 side) of the tube portion 14*a*. The anode block 14 is formed of metal having high thermal conductivity, for example, copper. The anode target 13 is joined to the outer surface of the bottom portion 14*b*.

The inner pipe 7*b* which is a part of the coolant pipe 7 is formed of, for example, stainless steel and is located on the inner side of the tube portion 14*a*. In other words, an outer surface SO7*b* of the inner pipe 7*b* is opposed to an inner circumferential surface S14*a* of the tube portion 14*a* and an inner surface S14*b* of the bottom portion 14*b*. The inner pipe 7*b* has a flow passage FP1 of the coolant defined by its inner surface SI7*b*, and has an outlet OL from which the coolant is discharged toward the bottom portion 14*b* in the end portion of the flow passage FP1. Furthermore, a flow passage FP2 of the coolant is formed between the outer surface SO7*b* of the inner pipe 7*b* and the anode block 14. That is, the flow passage FP2 corresponds to an area between the outer surface SO7*b* and the inner circumferential surface S14*a* and between the outer surface SO7*b* and the inner surface S14*b*. Arrows in the drawing show an example of the flow of the coolant in the flow passages FP1 and FP2.

In the present embodiment, the inner surface of the anode block 14 is covered with a protective film PR. More specifically, the protective film PR continuously covers the inner surface S14*b* of the bottom portion 14*b* and the inner circumferential surface S14*a* of the tube portion 14*a*. In the illustrated example, the protective film PR is disposed over the entire inner surface S14*b* and the entire inner circumferential surface S14*a*. Note that the protective film PR only needs to cover at least the entire inner surface S14*b* and an area in the vicinity of the boundary between the bottom portion 14*b* and the tube portion 14*a* of the inner circumferential surface S14*a*. For example, the area covered with the protective film PR of the inner circumferential surface S14*a* is, as indicated by a dashed line in the drawing, at least an area between the inner surface S14*b* and the outlet OL in the axial direction.

A first thickness T1 of the protective film PR covering the inner surface S14*b* is greater than a second thickness T2 of the protective film PR covering the inner circumferential surface S14*a*. Note that, in some cases, the second thickness T2 may be 0.

The inner surface S14*b* has a projection 14P located on the tube axis TA. The projection P14 projects toward the outlet OL. Also at a position overlapping the projection 14P, as in any other area of the inner surface S14*b*, the protective film PR has the first thickness T1. Therefore, the gap between the outlet OL and the protective film PR is smallest on the tube axis TA and gradually increases in the radial direction away from the tube axis TA.

In the coolant, in some cases, bubbles are generated by boiling of the coolant or a pressure difference of the coolant in the coolant circuit. When these bubbles evaporate, shock waves are generated. If the protective film PR covering the inner surface of the anode block 14 is formed of soft gold, the protective film PR is likely to be corroded by being repeatedly subjected to the shock waves generated by the evaporation of the bubbles. Depending on circumstances, erosion may progress to the anode block 14 or the anode target 13. Therefore, in the present embodiment, the protective film PR is formed of hard gold containing nickel (Ni). This protective film PR is formed by, for example, plating.

Figure 3:
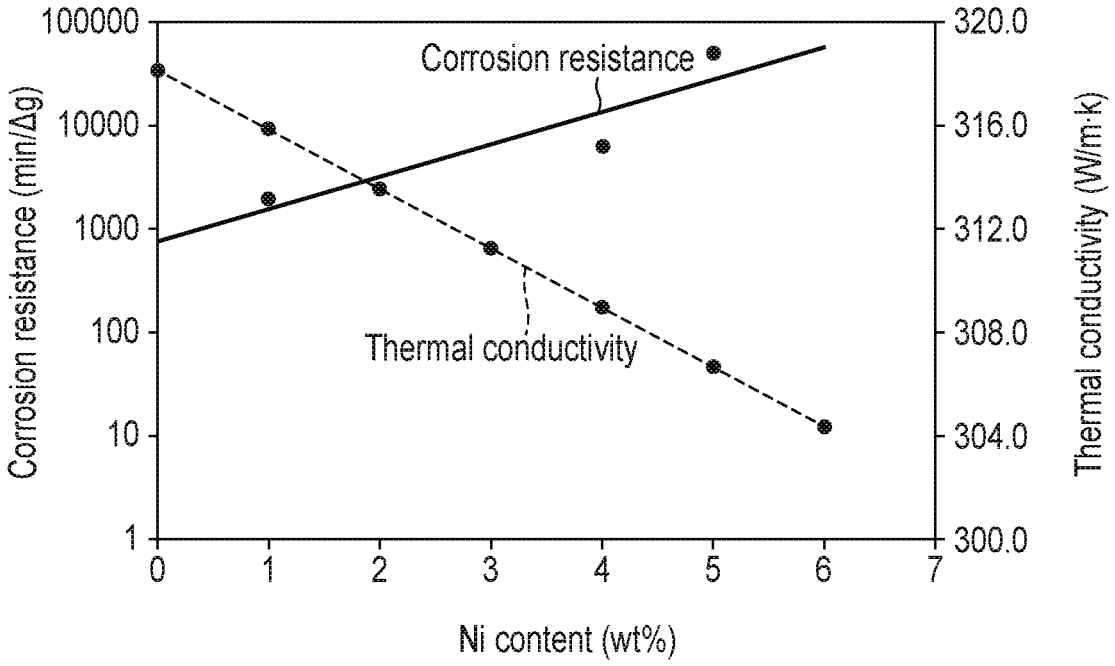
FIG. 3 is an illustration showing an example of a change in corrosion resistance and a change in thermal conductivity with respect to a nickel content in gold.

FIG. 3 is an illustration showing an example of the corrosion resistance and thermal conductivity of hard gold with respect to the nickel content. As shown in FIG. 3, as the nickel content in gold (hard gold) used as the protective film PR increases, the hardness of gold increases and the corrosion resistance improves. In the example shown in FIG. 3, when the nickel content is greater than or equal to 1 wt %, the corrosion resistance is about twice as high as compared to the corrosion resistance when the nickel content is 0 wt %. Therefore, the nickel content in the protective film PR is preferably greater than or equal to 1 wt % and is more preferably greater than 1 wt %.

On the other hand, as the nickel content in gold increases, the thermal conductivity of gold decreases. As the thermal conductivity of the protective film PR decreases, the cooling efficiency in the anode block 14 and the anode target 13 of the coolant decreases, and the surface (the target surface) of the anode target 13 is likely to be degraded. As a result, the product life of the X-ray tube assembly 1 is shortened, and the reliability is reduced. In the example shown in FIG. 3, when the nickel content in gold is less than or equal to 3 wt %, the decrease of the thermal conductivity falls within a range of about 3% as compared to the thermal conductivity when the nickel content is 0 wt %. Therefore, the nickel content in the protective film PR is preferably less than or equal to 3 wt %.

From the above, the nickel content in the protective film PR is preferably greater than or equal to 1 wt % but less than or equal to 3 wt % and is more preferably greater than 1 wt % but less than or equal to 3 wt %.

Next, the corrosion resistances (the cavitation resistances) of the protective film PR formed of hard gold (the protective film PR of the present embodiment) and a protective film formed of soft gold (a protective film of a comparative example) are compared under the same evaluation conditions.

Figure 4:
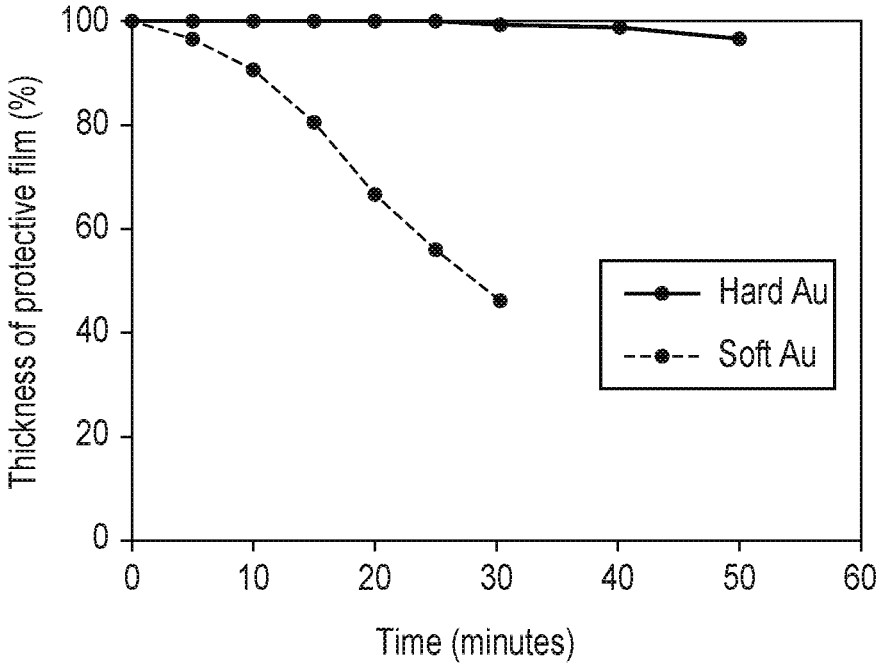
FIG. 4 is an illustration showing an example of changes in thickness of a protective film of the present embodiment and a protective film of a comparative example with respect to an amount of time they are exposed to a coolant.

FIG. 4 is an illustration showing changes in thickness of the protective films with respect to an amount of time the protective films are exposed to the coolant. The result shown in FIG. 4 is an example of chronological changes obtained in an experiment in which the protective film PR of the present embodiment and the protective film of the comparative example are sprayed with the coolant and immersed in the coolant under the same conditions.

As shown in FIG. 4, the thickness of the protective film of the comparative example formed of soft gold decreases over time. For example, after 30 minutes, the thickness of the protective film of the comparative example decreases to 45% of the thickness at the start of the experiment. On the other hand, the protective film PR of the present embodiment formed of hard gold hardly changes over time. For example, the thickness after 30 minutes is hardly changed from the thickness at the start of the experiment, and even after 50 minutes, greater than or equal to 95% of the thickness at the start of the experiment is maintained.

Therefore, by forming the protective film using not soft gold but hard gold, from the perspective of protection of the anode block 14, great improvements can be produced. In addition, by setting the nickel content in the protective film PR to greater than or equal to 1 wt % but less than or equal to 3 wt %, the decrease of the cooling efficiency in the anode block 14 and the anode target 13 can be suppressed, and the resistance to the corrosion and erosion of the protective film PR can be improved.

As described above, according to the present embodiment, the X-ray tube assembly 1 which can extend the product life can be provided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An X-ray tube assembly comprising:

a cathode configured to emit electrons;

an anode target configured to generate X-rays when the electrons emitted from the cathode collide therewith;

an anode block including a tube portion and a bottom portion closing one end side of the tube portion and joined to the anode target;

a coolant pipe located on an inner side of the tube portion, including an outlet from which a coolant is discharged toward the bottom portion, and forming a flow passage of the coolant between the coolant pipe and the anode block; and a protective film covering an inner surface of the bottom portion and formed of hard gold containing nickel, wherein the inner surface has a projection located on a tube axis, the protective film covers the projection, and a gap between the outlet and the protective film is smallest on the tube axis and gradually increases in a radial direction away from the tube axis.

2. The X-ray tube assembly of claim 1, wherein the hard gold contains nickel of greater than 1 wt %.

3. The X-ray tube assembly of claim 1, wherein the hard gold contains nickel of less than or equal to 3 wt %.

4. The X-ray tube assembly of claim 1, wherein the protective film continuously covers the inner surface of the bottom portion and an inner circumferential surface of the tube portion.

5. The X-ray tube assembly of claim 4, wherein a first thickness of the protective film covering the inner surface is greater than a second thickness of the protective film covering the inner circumferential surface.

6. The X-ray tube assembly of claim 1, wherein the hard gold contains nickel of greater than 1 wt %.

7. The X-ray tube assembly of claim 1, wherein the protective film continuously covers the inner surface of the bottom portion and an inner circumferential surface of the tube portion.

8. The X-ray tube assembly of claim 7, wherein a first thickness of the protective film covering the inner surface is greater than a second thickness of the protective film covering the inner circumferential surface.

9. An X-ray tube assembly comprising:

a cathode configured to emit electrons;

an anode target configured to generate X-rays when the electrons emitted from the cathode collide therewith;

an anode block including a tube portion and a bottom portion closing one end side of the tube portion and joined to the anode target;

a coolant pipe located on an inner side of the tube portion, including an outlet from which a coolant is discharged toward the bottom portion, and forming a flow passage of the coolant between the coolant pipe and the anode block; and a protective film covering an inner surface of the bottom portion and formed of hard gold containing nickel, wherein the hard gold contains nickel of less than or equal to 3 wt %.

* * * * *